US006612255B1

(12) United States Patent
Wragg

(10) Patent No.: US 6,612,255 B1
(45) Date of Patent: Sep. 2, 2003

(54) SEVERABLY SECTIONED AND STACKABLE BOAT

(76) Inventor: Thomas S. Wragg, 1027 Leucadia Blvd., Leucadia, CA (US) 92024

( * ) Notice: Subject to any disclaimer, the term of this patent is extended or adjusted under 35 U.S.C. 154(b) by 419 days.

(21) Appl. No.: 09/217,496

(22) Filed: Dec. 21, 1998

Related U.S. Application Data

(63) Continuation of application No. 08/857,627, filed on May 16, 1997, now abandoned.

(51) Int. Cl.[7] ..... B63B 7/04
(52) U.S. Cl. ..... 114/352
(58) Field of Search ..... 114/352–354, 266, 114/267

(56) References Cited

U.S. PATENT DOCUMENTS 2,514,303 A * 7/1950 Aimonetti ..... 114/352
3,121,887 A * 2/1964 Baretta ..... 114/354
3,381,322 A * 5/1968 Cook ..... 114/352
3,983,830 A * 10/1976 Morgan ..... 114/266

* cited by examiner

*Primary Examiner*—Ed Swinehart
(74) *Attorney, Agent, or Firm*—Brown Martin Haller & McClain LLP

(57) ABSTRACT

A boat has two or more open hull sections that may be assembled prior to using the boat and disassembled or separated from one another prior to transporting or storing the boat. The forwardmost hull section is defined by the bow and an aft bulkhead. Each section has an elongated rigid structural load-bearing member, such as a keel or a gunwale, extending between its forward and aft ends. Each end portion of such member couples with a facing end portion of an aligned of the structural load-bearing member of an adjacent hull section through a rigid, load-bearing and load-transferring elongated shank member. The cooperation of each pair of facing rigid members and the shank interfitted with them causes all hull sections to be integrated into a rigid, load-bearing unitary boat. A cable may extend the length of the boat to prevent the shanks from being displaced from their relationship with the rigid member end pairs during operation of the boat. Latches of any suitable type may be included on the gunwales, bulkheads or elsewhere for the same purpose.

24 Claims, 4 Drawing Sheets

SEVERABLY SECTIONED AND STACKABLE BOAT

CROSS-REFERENCE TO RELATED APPLICATION

This application is a continuation of application Ser. No. 08/857,627, filed May 16, 1997, now abandoned, of like title.

BACKGROUND OF THE INVENTION

1. Field of the Invention

The present invention relates generally to boats and, more specifically, to a small boat having sections that can be separated and stacked to facilitate storage or transportation, including portability, of the boat.

2. Description of the Related Art

Small open-hulled boats commonly used for fishing and recreational boating are variously known as skiffs, johnboats, launches and rowboats, among other names, depending on their construction and regional name preferences. Such boats have an open hull made of wood, aluminum, fiberglass or similar materials and one or more seats extending laterally across the hull between the gunwales. Although such a boat may be sufficiently light in weight to be carried to and from the water by as few as 2–4 people, the boat is nonetheless cumbersome to carry. Although the smaller types of such boats may be transported atop an automobile or other vehicle, several people are needed to load and unload the boat and carry it to and from the water. Furthermore, the boat occupies a relatively large space when stored on land or atop a vehicle.

Severably sectioned boats have been developed in an attempt to overcome the difficulties associated with transporting and storing small open-hulled boats. For example, U.S. Pat. No. 3,381,322, issued to Cook, describes a boat having sections or modules that may be separated from one another during transportation of the boat on land. Each section has a watertight bulkhead that enables the section to float even when separated from the other sections. The hull sections nest inside one another to minimize the space required to store the boat. The sections are connected by connectors that bridge the bulkheads and align the adjacent sections. The connectors serve a dual function because they are also part of the seats. Each section has tubes that, when the boat is aligned, register with one another from bow to stern through the gunwales and the keel. Cables extend through the tubes to tie the sections together. A screw fitting is then adjusted in a turnbuckle-like manner to exert tension on the cable.

The boat described in the Cook patent suffers from several problems. The most critical of these problems is that the sections are likely to separate during rough use because the cables and bulkhead connectors do not connect the sections together very securely.

U.S. Pat. No. 4,779,556, issued to Smith, describes a similar boat in which fasteners such as bolts connect adjacent bulkheads. U.S. Pat. No. 3,340,552, issued to Moye, describes a similar boat in which over-center latches on the gunwales as well as threaded vertical rods connect the sections together.

It would be desirable to provide a severably sectioned boat having sections that can be connected more securely than those of prior boats and that provide improved structural integrity when connected. These needs are clearly felt in the art and are satisfied by the present invention in the manner described below.

SUMMARY OF THE INVENTION

The present invention relates to a boat having two or more open hull sections that may be assembled prior to using the boat and disassembled or separated from one another prior to transporting or storing the boat. The forwardmost hull section is defined by the bow and an aft bulkhead. The aftmost hull section is defined by the transom and a forward bulkhead. Each middle hull section, in embodiments of the invention having more than two hull sections, is defined by a forward bulkhead and an aft bulkhead. An important feature of the invention is that the sections are rigidly joined through elongated structural load-bearing members extending between each section's forward and aft ends. The structural load-bearing rigid members may include the keel or the gunwales or both. Each end portion of such member aligns and couples with a facing end portion of the structural load-bearing member of an adjacent hull section through a rigid, load-bearing and load-transferring elongated shank member. The cooperation of each pair of facing rigid members and the shank interfitted with them causes all hull sections to be integrated into a rigid, load-bearing unitary boat. A cable may extend the length of the boat to prevent the shanks from being displaced from their relationship with the rigid member end pairs during operation of the boat. Latches of any suitable type may be included on the gunwales, bulkheads or elsewhere for the same purpose.

Therefore, in one broad embodiment, the present invention is a boat comprising a linear fore-and-aft alignment of a plurality of floatable hull sections, each section comprising a bottom, a pair of opposed sides and a transverse bulkhead, and having a forward end and an aft end, and having extending between the forward and aft ends at least one rigid member, each rigid member having a respective terminal end adjacent each of the forward end and aft end; the rigid members being disposed on each of the respective hull sections such that when the hull sections are linearly aligned the rigid members are correspondingly linearly aligned, such that pairs of opposed terminal ends of a rigid members are disposed in facing relationships on respective adjacent hull sections; at least one rigid elongated linear shank member; each shank member spanning between a pair of facing terminal ends and cooperating therewith to form a rigid, load bearing coupling between the adjacent sections; such that cooperation between each respective shank member and pair of facing terminal ends for all the hull sections couples the hull sections into a rigid, load bearing unitary boat.

In another broad embodiment, the invention is of a method for assembling a boat, comprising the steps of providing a plurality of floatable hull sections, each section comprising a bottom, a pair of opposed sides and a transverse bulkhead, and having a forward end and an aft end, and having extending between the forward and aft ends at least one rigid member, each rigid member having a respective terminal end adjacent each of the forward end and aft end; disposing the rigid members on each of the respective hull sections such that when the hull sections are linearly aligned the rigid members are correspondingly linearly aligned, such that pairs of opposed terminal ends of a rigid members are disposed in facing relationships on respective adjacent hull sections; providing at least one rigid elongated linear shank member; aligning the hull sections in a linear, fore-and-aft alignment with the pairs of opposed terminal ends of the rigid members correspondingly aligned; and disposing a shank member between each pair of facing terminal ends in a cooperating relationship therewith to form a rigid, load bearing coupling between the adjacent sections;

whereby such cooperation between each respective shank member and pair of facing terminal ends for all the hull sections couples the hull sections and forms the plurality of hull sections into a rigid, load bearing unitary boat.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF PREFERRED EMBODIMENTS

Figure 1:
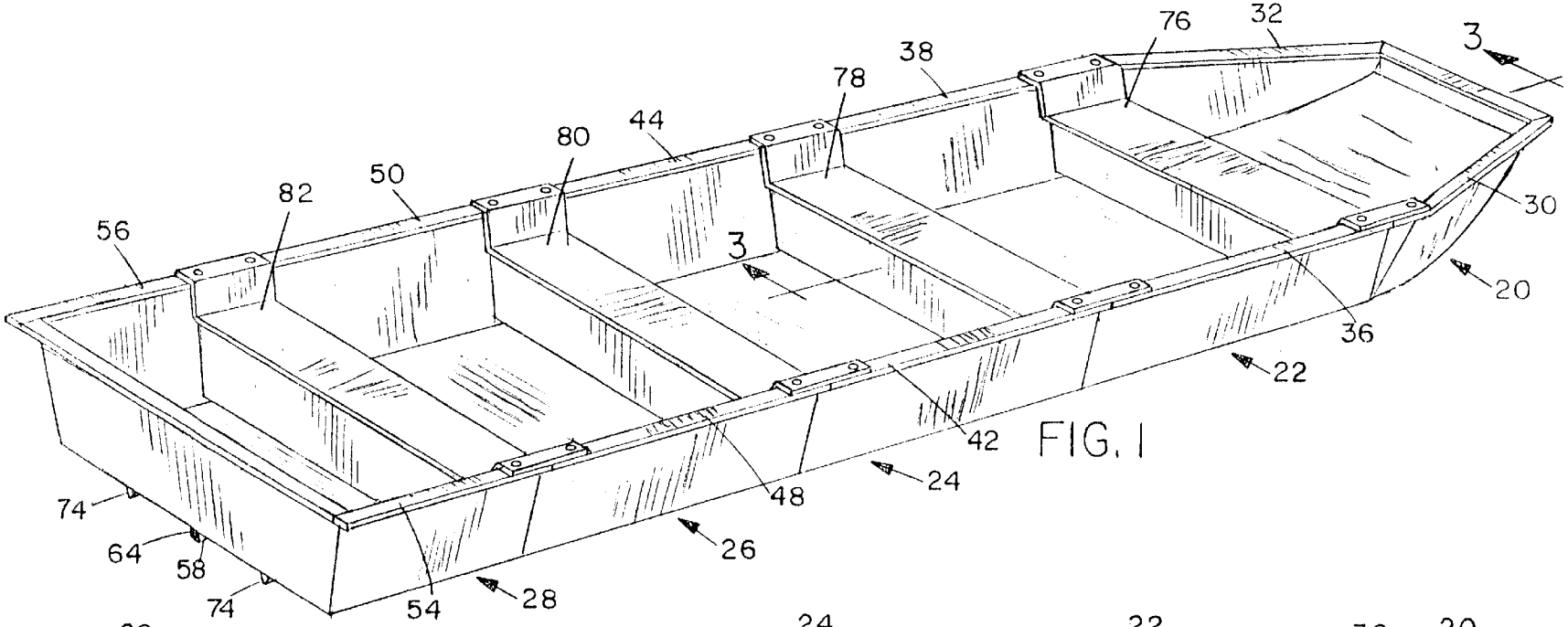
FIG. 1 is a perspective view of the assembled boat.

As illustrated in FIGS. 1–4, a boat includes hull sections 20, 22, 24, 26 and 28 that a user may removably or severably couple to one another in the manner described below. Sections 20–28 may thus be coupled to one another to assemble the boat preparatory to use and uncoupled from one another to disassemble the boat preparatory to storage or transportation. Hull section 20, which defines the bow of the assembled boat, has gunwale members 30 and 32 and a keel member 34; hull section 22, which defines a midportion of the assembled boat, has gunwale members 36 and 38 and a keel member 40; hull section 24, which defines another midportion of the assembled boat, has gunwale members 42 and 44 and a keel member 46; hull section 26, which defines still another midportion of the assembled boat, has gunwale members 48 and 50 and a keel member 52; hull section 28, which defines the stern of the assembled boat, has gunwale members 54 and 56 and a keel member 58.

As more clearly illustrated in FIGS. 4–19, each of gunwale members 30, 32, 36, 38, 42, 44, 48, 50, 54 and 56 and each of keel members 34, 40, 46, 52 and 58 is preferably a hollow metal tube having a generally rectangular cross-sectional shape. This construction provides hull sections 20, 22, 24, 26 and 28 with rigidity and structural load-bearing strength that common hull wall materials, such as fiberglass or sheet aluminum, would not alone provide.

The aft end of each of gunwale members 30, 32, 42 and 44 and the forward end of each of gunwale members 42, 44, 54 and 56 has an elongated shank 60 that is preferably made of solid metal of rectangular cross-section. Similarly, the aft end of each of keel members 34 and 46 and the forward end of each of keel members 46 and 58 has elongated shank 60. A portion of shank 60 is preferably welded in place in the end of its corresponding gunwale or keel member, with approximately one-half the length of shank 60 inside the member and one-half the length of shank 60 projecting therefrom.

Figure 2:
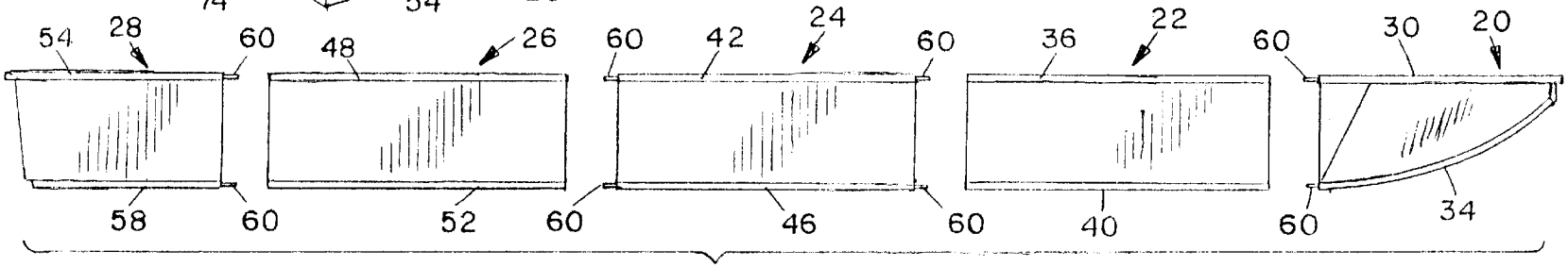
FIG. 2 is a side elevation view with the hull sections separated.

Referring to FIG. 2, to assemble the boat, hull section 20 is coupled to hull section 22, which in turn is coupled to hull section 24. Hull section 24 in turn is coupled to hull section 26, which in turn is coupled to hull section 28. To couple hull section 20 to hull section 22, shanks 60 of the aft ends of gunwale members 30 and 32 are inserted into the forward ends of gunwale members 36 and 38, respectively, while shank 60 of the aft end of keel member 34 is inserted into the forward end of keel member 40. To couple hull section 22 to hull section 24, shanks 60 of the forward ends of gunwale members 42 and 44 are inserted into the aft ends of gunwale members 36 and 38 respectively, while shank 60 of the forward end of keel member 46 is inserted into the aft end of keel member 40. To couple hull section 24 to hull section 26, shanks 60 of the aft ends of gunwale members 42 and 44 are inserted into the forward ends of gunwale members 48 and 50, respectively, while shank 60 of the aft end of keel member 46 is inserted into the forward end of keel member 52. To couple hull section 26 to hull section 28, shanks 60 of the forward ends of gunwale members 54 and 56 are inserted into the aft ends of gunwale members 48 and 50, respectively, while shank 60 of the forward end of keel member 58 is inserted into the aft end of keel member 52. This forms the structure of the assembled boat.

Figures 3, 4, 5, 6, 7:
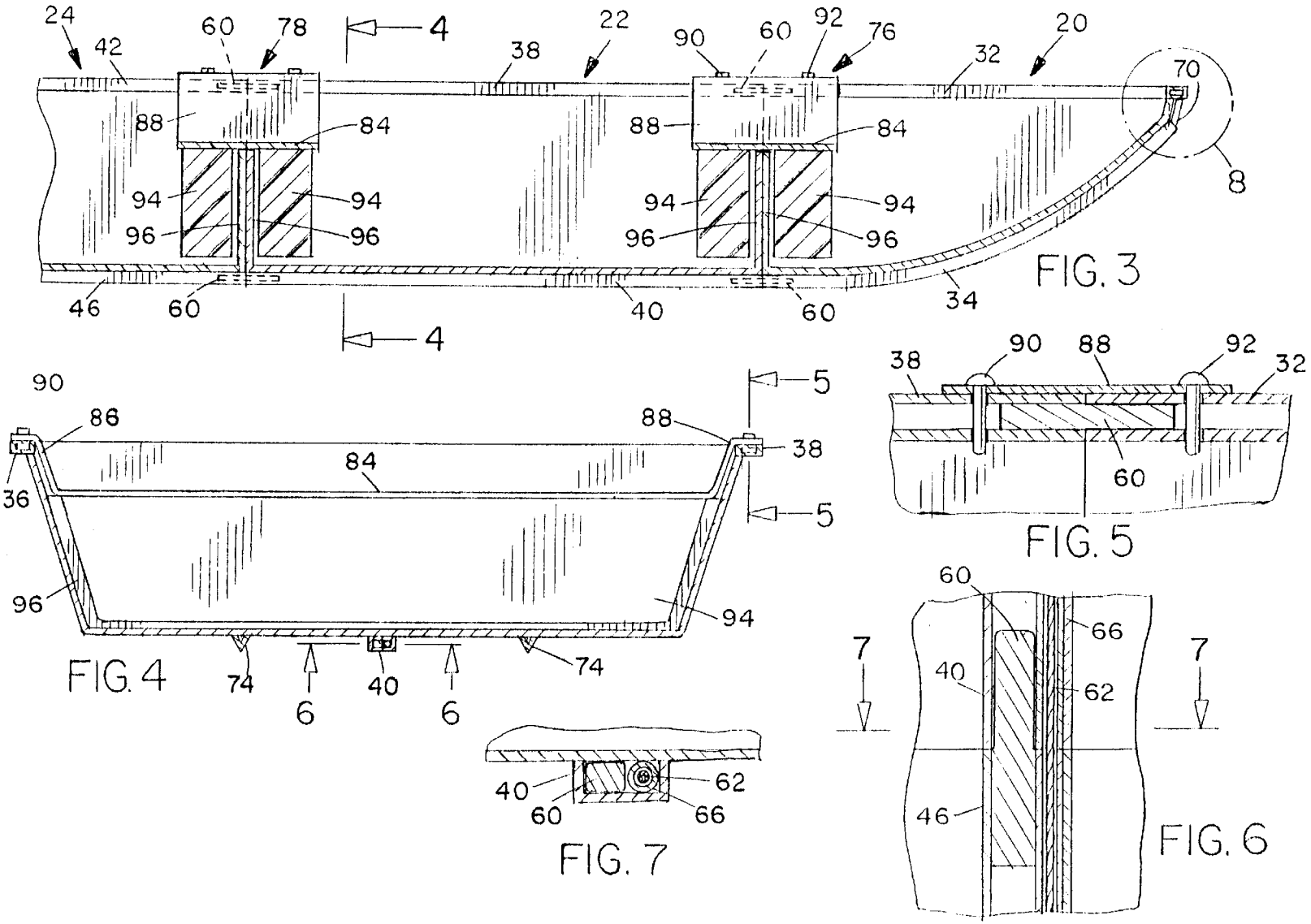
FIG. 3 is an enlarged sectional view taken on line 3—3 of FIG. 1.
FIG. 4 is a sectional view taken on line 4—4 of FIG. 3.
FIG. 5 is an enlarged sectional view taken on line 5—5 of FIG. 4.
FIG. 6 is an enlarged sectional view taken on line 6—6 of FIG. 4.
FIG. 7 is an enlarged sectional view taken on line 7—7 of FIG. 6.
Figure 8:
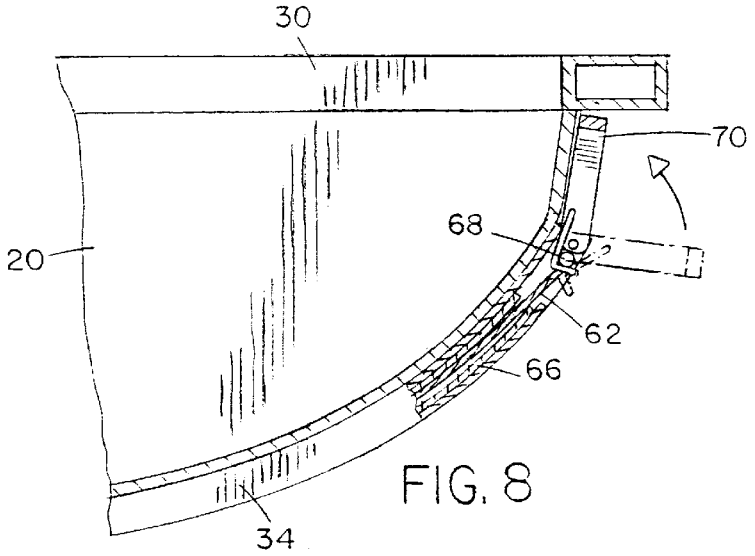
FIG. 8 is an enlargement of the encircled structure 8 in FIG. 3.

As best illustrated in FIGS. 6–8, a retaining cable 62 is threaded between the fore and aft ends of the assembled boat through all keel members 34, 40, 46, 52 and 58. The aft end of cable 62 has a ball 64 attached to it that abuts the aft end of keel member 58. Ball 64 is larger than the opening in the aft end of keel member 58, thereby restraining the aft end of cable 62 against forward movement. Each of keel members 34, 40, 46, 52 and 58 has a cable duct 66 extending through it, and cable 62 is threaded through each cable duct 66. As illustrated in FIG. 8, the forward end of cable 62 has a ball 68 that is engaged by an over-center latch 70. Over-center latch 70 is a well-known type of latch and is widely commercially available. Pivoting the handle of over-center latch 70 away from cable 62 to the position shown in solid line in FIG. 8 draws cable 62 taut, thereby retaining shanks 60 against unintended disengagement. Pivoting the handle toward cable 62 to the position shown in phantom line in FIG. 8 slackens cable 62, thereby allowing the user to disengage the latch fork from ball 68. Because ball 68 is smaller than the the diameter of cable ducts 66, a user can remove cable 62 by pulling ball 64 from the stern of the boat.

In contrast to prior boats, such as that described in U.S. Pat. No. 3,381,322, issued to Cook, when hull sections 20, 22, 24, 26 and 28 are coupled to one another, structural load-bearing keel members 34, 40, 46, 52 and 58 of the present invention cooperate to form an integral keel, structural load-bearing gunwale members 30, 36, 42, 48 and 54 cooperate to form an integral load-bearing starboard gunwale, and structural load-bearing gunwale members 32, 38, 44, 50 and 56 cooperate to form an integral load-bearing port gunwale. In prior boats, such as that described in the above-referenced Cook patent, tubes "register" with one another, i.e., they are aligned, but they do not interfit or couple to one another. Moreover, the tubes of the prior boats are not structural load-bearing members. Because they are not structural load-bearing members, and because they do not structurally couple to one another, they cannot distribute the load experienced by a hull section to other hull sections. In the present invention, when the boat is assembled, the keel and gunwales are integral structural load-bearing members that distribute load forces over the length of the boat. The assembled boat thus is more structurally sound than prior severably sectioned boats.

As illustrated in FIGS. 1 and 4, the assembled boat also has strakes 72 and 74, which are defined by strake members attached to the bottom of each of hull sections 20, 22, 24, 26 and 28 that are aligned in a manner similar to the gunwale members and keel members. Strakes 72 and 74 function in the conventional manner.

Referring again to FIG. 1, the boat further includes seat assemblies 76, 78, 80 and 82 that not only provide seating for users of the assembled boat but also assist in retaining shanks 60 into their corresponding gunwale members. Each of seat assemblies 76, 78, 80 and 82 includes a seating area 84 that extends between a starboard hanger plate 86 and a port hanger plate 88. Hanger plates 86 and 88 rest on the gunwales when the boat is assembled. In certain embodiments of the present invention, hanger plates 86 and 88 each have pins 90 and 92 that extend downwardly into holes in the gunwales. Such a pin 90 engages a hole in the gunwale of one of hull sections 20, 22, 24, 26 and 28, and pin 92 engages a hole in the gunwale of an adjoining one of hull sections 20, 22, 24, 26 and 28. In other embodiments, clips (not shown) may secure such pins. Plates 86 and 88 thus span the joint between two hull sections to latch them to one another. Each of seat assemblies 76, 78, 80 and 82 also includes flotation material 94, such as closed-cell plastic foam of the type commonly used in marine safety flotation devices. To further facilitate latching or retaining of the hull sections together, each of seat assemblies 76, 78, 80 and 82 preferably spans the bulkheads 96 of adjoining hull sections.

In alternative embodiments, other latching mechanisms may be used in place of or in addition to that described above to retain shanks 60 against disengagement. Such alternative latches may be used in any suitable combination with one another.

Figure 9:
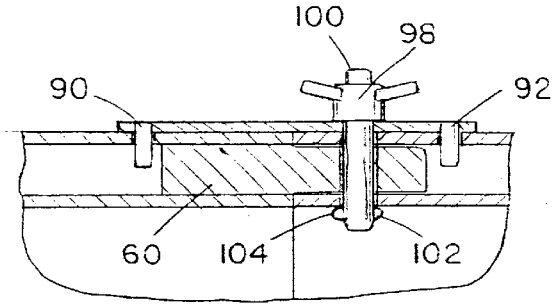
FIG. 9 is a view similar to FIG. 5, showing an alternative latch of a push-pin type.
Figure 10:
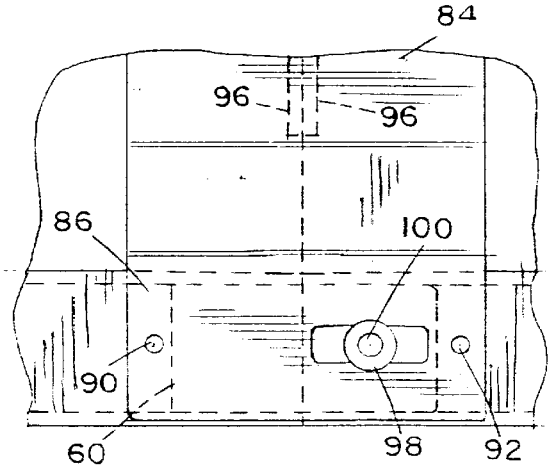
FIG. 10 is a top plan view of the structure of FIG. 9.

One such latch is illustrated in FIGS. 9–10. A push-pin latch 98 is a well-known type of latch that is widely commercially available. Latch 98 is mounted on the top (or, alternatively, the bottom) of hanger plates 86 and 88. A portion of latch 98 extends through the mating portions of the gunwale members of adjoining hull sections. When a user presses pushbutton 100, pins 102 and 104 retract to disengage them from the gunwale. The user may then remove the seat assembly to unlatch the hull sections.

Figure 11:
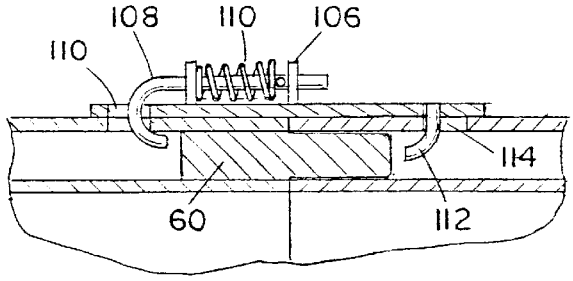
FIG. 11 is a view similar to FIG. 5, showing a latch of a spring-loaded hook type.
Figure 12:
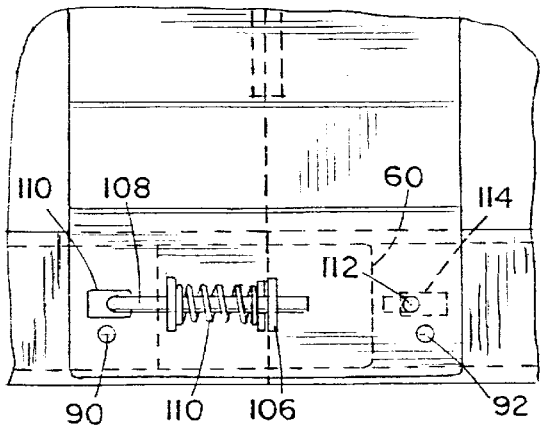
FIG. 12 is a top plan view of the structure of FIG. 11.

Another such latch is illustrated in FIGS. 11–12. A spring-loaded hook latch 106 mounted on the top (or, alternatively, the bottom) of hanger plates 86 and 88 includes a J-shaped hook 108 that engages the gunwale through a slot 110. Another hook 112 extending downwardly from hanger plates 86 and 88 engages another slot 114 in the gunwale. When a user moves hook 108 such that the end of it clears slot 110, the user can remove the seat assembly to unlatch the adjoining hull sections.

Figure 13:
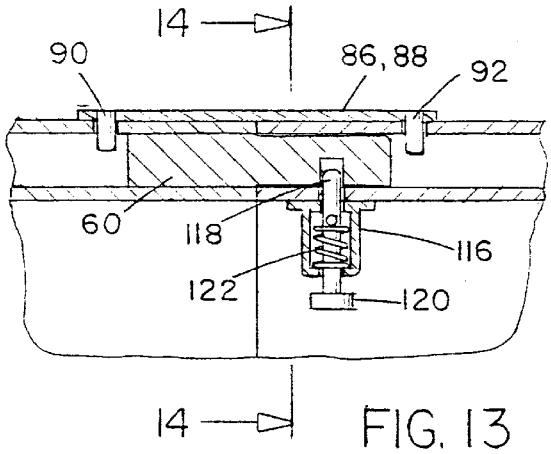
FIG. 13 is a view similar to FIG. 5, showing a latch of a spring-loaded pin type.
Figure 14:
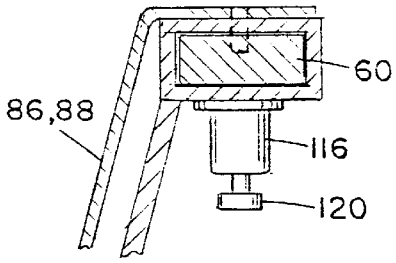
FIG. 14 is a sectional view taken on line 14—14 of FIG. 13.

Another such latch is illustrated in FIGS. 13–14. A spring-loaded pin latch 116 is mounted on the bottom (or, alternatively, the top) of hanger plates 86 and 88. Alternatively, in other embodiments of the present invention (not shown), the pin may be mounted on the gunwale or keel member next to a corresponding shank. In the embodiment illustrated in FIGS. 13–14, pin portion 118 of latch 116 extends through the mating portions of the gunwale members. When a user pulls a knob portion 120, thereby compressing spring 122, pin portion 118 retracts and disengages from the gunwale member.

Figure 15:
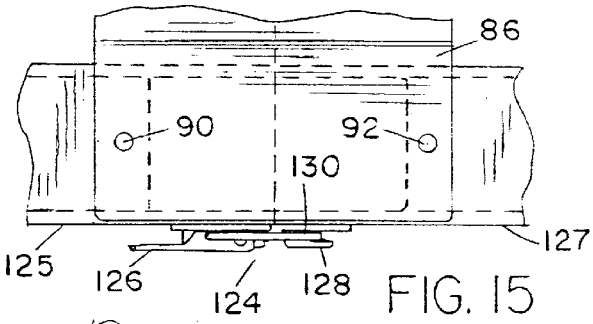
FIG. 15 is a top plan view of a latch of a toggle type.

Another such latch is illustrated in FIG. 15. A toggle latch 124 is a well-known type of latch that is widely commercially available. A lever portion 126 of toggle latch 124 is mounted on the outboard sidewall 125 of a gunwale member, and a catch portion 126 of toggle latch 124 is mounted on the corresponding sidewall 127 of an adjoining gunwale member. Alternatively, in other embodiments (not shown), lever portion 126 may be integrated with the seat hanger plate 86 and 88. When a user flips lever portion 126 outwardly away from sidewall 125, the bail portion 130 of toggle latch 124 disengages from catch portion 126.

Figure 16:
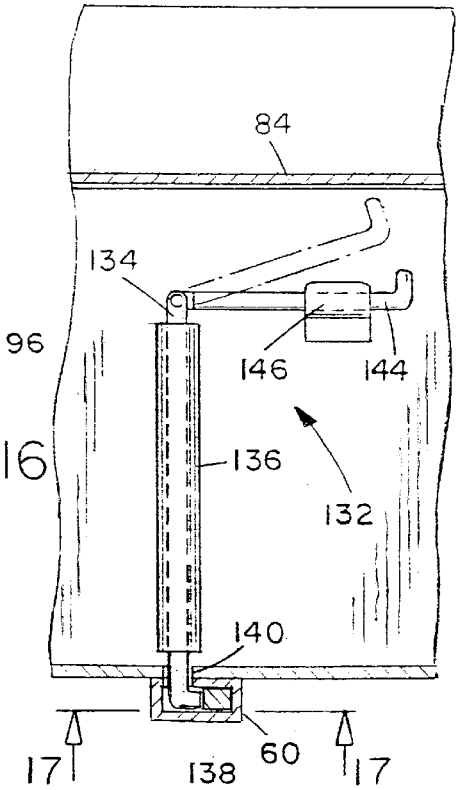
FIG. 16 is a view similar to an enlarged portion of FIG. 4, showing a latch of a cam-lever type.
Figure 17:
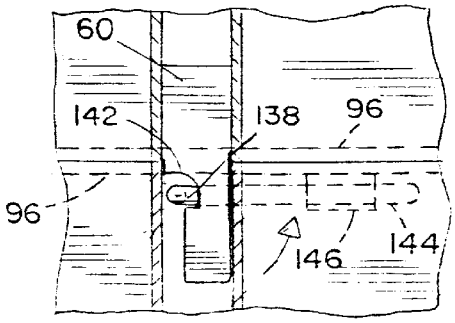
FIG. 17 is a sectional view taken on line 17—17 of FIG. 16.

A cam-lever latch 132 is illustrated in FIGS. 16–17. A hinge pin 134 of cam-lever latch 132 extends through a tube 136 that is mounted vertically on a bulkhead 96. The L-shaped portion or cam end 138 is retained inside of the keel member of the hull section in the area of coupling by the upper edge of the keel member. The handle portion or lever end 144 pivots between a position axially aligned with pin portion 134 and a position perpendicular to pin portion 134 and parallel to cam end 138. Cam end 138 is in the latched position when lever end 144 rests in a support 146 mounted on bulkhead 96 when lever end 144 is perpendicular to pin portion 134. Shank 60 of the adjoining hull section has a slot 140 that allows cam end 138 to clear shank 60 when in the open or unlatched position. A secondary slot 142, with a step, is cut in the shank and is positioned to allow rotation of lever end 144 (and thus cam end 138) until contact is made between cam end 138 and the step, at which point further rotation of lever end 144 draws the shank further into the keel member. Lever end 144 is retained in support 146 at the same time that cam end 138 has drawn the shank into the keel member its maximum distance (torsional pressure may be applied). To latch adjoining hull sections, the user lifts and releases lever end 144 from support 146 and rotates it to the released position (approximately 90 degrees from the latched position). The user then slides the adjoining hull section into approximate position and rotates lever end 144 back into the latched position and lowers it into support 146. To unlatch the hull sections, the user lifts and releases lever end 144 from support 146 and rotates it to the released position (approximately 90 degrees from the latched position). The user then separates the adjoining hull sections.

Figure 18:
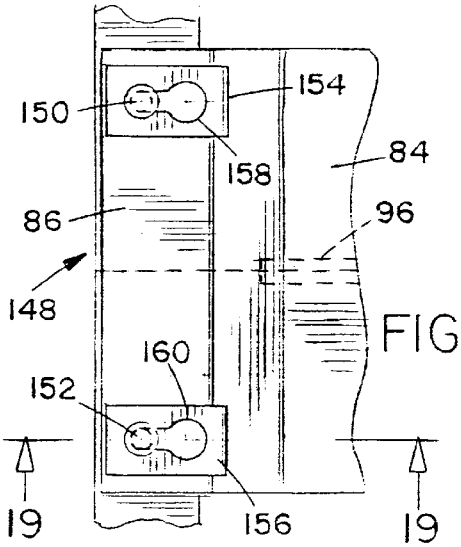
FIG. 18 is a top plan view of a seat attachment at a hull joint, with a latch of a slide-lock type.
Figure 19:
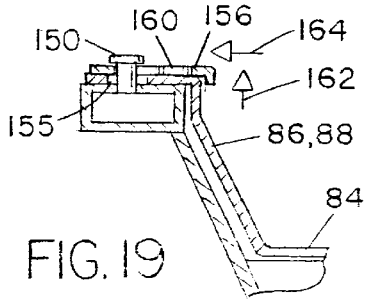
FIG. 19 is a sectional view taken on line 19—19 of FIG. 18.

Yet another alternative latch is illustrated in FIGS. 18–19. A slide-lock latch 148 includes two pins 150 and 152 having enlarged heads and two clips 154 and 156. Pins 150 and 152 are mounted on the respective top surfaces of the gunwales of adjoining hull sections. In this embodiment, hanger plates 86 and 88 have openings 155 sufficiently large to pass the heads of pins 150 and 152. To latch the hull sections, a seat assembly is mounted as described above but with openings 155 over pins 150 and 152, such that the heads of pins 150 and 152 extend above the surface of the hanger plate. Clips 154 and 156 have keyhole-shaped openings 158 and 160, respectively. Clip 154 is then placed over pin 150, such that the head of pin 150 is passed through the enlarged portion of opening 158. Clip 154 is then slid into the position illustrated in FIG. 18. Similarly, clip 156 is placed over pin 152, such that the head of pin 152 is passed through the enlarged portion of opening 160. Clip 156 is then slid into the position illustrated in FIG. 18. To unlatch the hull sections, the user first lifts the edges of clips 154 and 156 slightly in the direction of the arrow 162 and then slides them in the direction of the arrow 164 (FIG. 19). With the heads of pins 150 and 152 in the enlarged portions of openings 158 and 160, the user may remove clips 154 and 156 and then remove the seat assembly.

Other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

What is claimed is:

1. A boat comprising:

a linear fore-and-aft alignment of a plurality of floatable hull sections, each section comprising a bottom, a pair of opposed sides and a transverse bulkhead, and having a forward end and an aft end, and having extending between said forward and aft ends at least one rigid member, each said rigid member having a respective terminal end adjacent each of said forward end and aft end;

said rigid members being disposed on each of said respective hull sections such that when said hull sections are linearly aligned said rigid members are correspondingly linearly aligned, such that pairs of opposed terminal ends of a rigid members are disposed in facing relationships on respective adjacent hull sections;

at least one rigid elongated linear shank member;

each said shank member spanning between a pair of facing terminal ends and cooperating therewith to form a releasable rigid, load bearing coupling between said adjacent sections;

such that cooperation between each respective shank member and pair of facing terminal ends for all said hull sections couples said hull sections into a rigid, load bearing unitary boat.

2. A boat as claimed in claim 1 wherein at least one terminal end of said pair of facing terminal ends has an elongated longitudinal recess formed therein for receiving a portion of said shank member.

3. A boat as claimed in claim 2 wherein each of said terminal ends of said pair of facing terminal ends has an elongated longitudinal recess formed therein for receiving a portion of said shank member.

4. A boat as claimed in claim 3 wherein said shank member comprises two ends, each of which is releasably received and interfitted into a respective recess to a depth of substantially one-half of said shank member, such that interfitted shank member and recesses cooperate to form a rigid, load-transferring coupling between said adjacent sections.

5. A boat as claimed in claim 2 wherein one of said terminal ends has said recess and another facing end of said pair of facing terminal ends has incorporated therewith and projecting axially outwardly therefrom said shank member, such projecting shank member interfitting within said recess, such that interfitted shank member and recess cooperate to form a rigid, load-transferring coupling between said adjacent sections.

6. A boat as claimed in claim 1 wherein each said rigid member forms a keel of a section.

7. A boat as claimed in claim 1 wherein each said rigid member forms a gunwale of a section.

8. A boat as claimed in claim 1 further comprising a plurality of said rigid members incorporated in each said section, such that when said sections are linearly aligned and said shank members interfit with and couple all said pairs of facing terminal ends of said rigid members, a plurality of corresponding plurality of continuous, rigid, load bearing coupled rigid members runs between forward and aft ends of and forms said unitary boat hull.

9. A boat as claimed in claim 8 wherein said plurality of coupled rigid members forms a corresponding plurality of keels of said unitary boat.

10. A boat as claimed in claim 8 wherein said plurality of coupled rigid members forms a corresponding plurality of gunwales of said unitary boat.

11. A boat as claimed in claim 8 wherein said plurality of coupled rigid members forms at least one keel and one gunwale of said unitary boat.

12. A boat as claimed in claim 1 wherein each said shank member has a rectangular cross-section and fits into a recess with a corresponding rectangular cross-section.

13. A boat as claimed in claim 12 wherein each said shank member is releasably received in said corresponding recess.

14. A boat as claimed in claim 13 further comprising a cable running between a forward end and an aft end of said unitary boat and being releasably attached to said boat at said ends, such that said shank members are prevented from being displaced from said terminal end recesses during operation of said unitary boat.

15. A boat as claimed in claim 14 wherein attachment of said cable at at least one of said ends comprises an over-center buckle attached to said end of said boat hull to draw said cable taut.

16. A boat as claimed in claim 14 wherein each rigid member in a series of aligned rigid members on said plurality of sections has a cable duct running longitudinally therethrough, with said cable passing through aligned cable ducts between said forward and aft ends of said boat.

17. A boat as claimed in claim 1 further comprising a least one of each pair of adjacent sections having latching means thereon for latching together said pair of adjacent sections, such that said shank members are prevented from being displaced from said terminal end recesses during operation of said unitary boat.

18. A method for assembling a boat, comprising the steps of:

providing a plurality of floatable hull sections, each section comprising a bottom, a pair of opposed sides and a transverse bulkhead, and having a forward end and an aft end, and having extending between said forward and aft ends at least one rigid member, each said rigid member having a respective terminal end adjacent each of said forward end and aft end;

disposing said rigid members on each of said respective hull sections such that when said hull sections are linearly aligned said rigid members are correspondingly linearly aligned, such that pairs of opposed terminal ends of a rigid members are disposed in facing relationships on respective adjacent hull sections;

providing at least one rigid elongated linear shank member;

aligning said hull sections in a linear, fore-and-aft alignment with said pairs of opposed terminal ends of said rigid members correspondingly aligned;

disposing a shank member between each said pair of facing terminal ends in a cooperating relationship therewith to form a rigid, load bearing coupling between said adjacent sections;

whereby such cooperation between each respective shank member and pair of facing terminal ends for all said hull sections couples said hull sections and forms said plurality of hull sections into a rigid, load bearing unitary boat.

19. A method as claimed in claim 18 wherein at least one terminal end of said pair of facing terminal ends has an elongated longitudinal recess formed therein for receiving a portion of said shank member, said method further comprising releasably seating said portion of said shank member in said recess such that seated shank member and recess cooperate to form a rigid, load-transferring coupling between said adjacent sections.

20. A method as claimed in claim 19 wherein each of said terminal ends of said pair of facing terminal ends has an elongated longitudinal recess formed therein for receiving a respective portion of said shank member, said method further comprising releasably seating said respective portion of said shank member in each said recess, such that seated shank member and recesses cooperate to form a rigid, load-transferring coupling between said adjacent sections.

21. A method as claimed in claim 18 wherein said shank member comprises two ends, said method further comprising releasably receiving and interfitting said shank member into a respective recess to a depth of substantially one-half of said shank member, such that interfitted shank member and recesses cooperate to form a rigid, load-transferring coupling between said adjacent sections.

22. A method as claimed in claim 18 wherein one of said terminal ends has said recess and another facing end of said pair of facing terminal ends has incorporated therewith and projecting axially outwardly therefrom said shank member, said method further comprising interfitting such projecting shank member within said recess, such that interfitted shank member and recess cooperate to form a rigid, load-transferring coupling between said adjacent sections.

23. A method as claimed in claim 18 further comprising disposing a cable between a forward end and an aft end of said unitary boat and releasably attaching said cable to said boat at said ends, such that said cable prevents said shank members from being displaced from said terminal end recesses during operation of said unitary boat.

24. A method as claimed in claim 18 further comprising disposing on a least one of each pair of adjacent sections latching means thereon, and latching together said pair of adjacent sections, such that said shank members are prevented from being displaced from said terminal end recesses during operation of said unitary boat.

* * * * *